United States Patent [19]

Bloom et al.

[11] Patent Number: 4,772,826

[45] Date of Patent: Sep. 20, 1988

[54] COLOR DISPLAY SYSTEM

[75] Inventors: Stanley Bloom, Bridgewater Township, Somerset County; Eric F. Hockings, Princeton, both of N.J.

[73] Assignee: RCA Licensing Corporation, Princeton, N.J.

[21] Appl. No.: 879,194

[22] Filed: Jun. 26, 1986

[51] Int. Cl.[4] ..... H01J 29/58

[52] U.S. Cl. ..... 315/382; 315/368; 315/371; 313/412

[58] Field of Search ..... 315/371, 368, 382, 368 RE; 313/412

[56] References Cited

U.S. PATENT DOCUMENTS

| | | | |
|---|---|---|---|
| Re. 29,470 | 8/1978 | Yoshida et al. | 315/368 |
| 2,907,915 | 10/1959 | Gleichauf | 315/13 |
| 3,452,240 | 6/1969 | Tokita et al. | 315/368 |
| 3,462,638 | 8/1969 | Tetsuo et al. | 315/368 |
| 3,467,881 | 9/1969 | Ohgoshi et al. | 315/368 |
| 3,500,114 | 3/1970 | Sawai | 315/368 |
| 3,548,248 | 12/1970 | Tokita et al. | 315/368 |
| 3,548,249 | 12/1970 | Yoshida et al. | 315/368 |
| 3,590,302 | 6/1971 | Bussey | 313/77 |
| 3,594,600 | 7/1971 | Murata et al. | 315/368 |
| 3,614,501 | 10/1971 | Ohgoshi et al. | 313/412 |
| 3,614,502 | 10/1971 | Doggett et al. | 313/77 |
| 3,619,687 | 11/1971 | Miyaoka et al. | 315/368 |
| 3,638,064 | 1/1972 | Hosoya et al. | 315/368 |
| 3,651,359 | 3/1972 | Miyaoka | 315/368 |
| 3,651,369 | 3/1972 | Sawai | 315/368 |
| 3,778,666 | 12/1973 | Miyaoka et al. | 315/13 C |
| 3,873,879 | 3/1975 | Hughes | 315/368 |
| 3,887,837 | 6/1975 | Nakayama et al. | 315/368 |
| 3,916,244 | 10/1975 | Evans, Jr. | 313/412 |
| 3,930,185 | 12/1975 | Barkow et al. | 315/368 |
| 3,952,227 | 4/1976 | Van Alphen | 315/382 |
| 4,058,753 | 11/1977 | Blacker et al. | 315/368 |
| 4,090,110 | 5/1978 | Ogawa et al. | 315/368 |
| 4,142,131 | 2/1979 | Ando et al. | 315/368 |
| 4,277,722 | 7/1981 | Hawken et al. | 315/382 |
| 4,470,029 | 9/1984 | Chase | 335/210 |
| 4,499,457 | 2/1985 | Hintze | 315/382 |
| 4,528,476 | 7/1985 | Alig | 313/412 |
| 4,697,120 | 9/1987 | Alig et al. | 313/412 |

FOREIGN PATENT DOCUMENTS

| | | | |
|---|---|---|---|
| 0116371 | 9/1981 | Japan | 315/371 |

*Primary Examiner*—Thodore M. Blum
*Assistant Examiner*—David Cain
*Attorney, Agent, or Firm*—Eugene M. Whitacre; Dennis H. Irlbeck

[57] ABSTRACT

A color display system includes a cathode-ray tube and yoke. The yoke is a non-converging type. The cathode-ray tube has an electron gun for generating and directing three electron beams, a center beam and two outer beams, along paths toward a screen of the tube. The electron gun includes electrodes that comprise a beam-forming region and electrodes that form a main focusing lens. The main focusing lens is formed by at least two focusing electrodes. The focusing electrode closest to the beam-forming region includes at least two spaced parts. Each spaced part forms a portion of a dipole lens structure in the path of an outer electron beam. Means are provided for applying to at least one of the spaced parts a dynamic signal which is related to the deflection of the electron beams.

5 Claims, 5 Drawing Sheets

COLOR DISPLAY SYSTEM

The present invention relates to color display systems including cathode-ray tubes having inline electron guns, and particularly to such guns having means therein for providing electrostatic dynamic convergence of the electron beams formed by the electron guns.

BACKGROUND OF THE INVENTION

Prior to development of self-converging yokes, beam convergence was usually achieved by use of dynamically varied magnetic fields that were coupled to plates or pole pieces located at the output end of an electron gun. The magnetic fields were formed by electromagnetic components located outside the neck of the tube. However, the adjustments for such a dynamic convergence system was extremely complex and time consuming. In response to this adjustment problem, a system utilizing a self-converging yoke was developed.

Although most present-day deflection yokes produce a self-convergence of the three beams in a cathode-ray tube, the price paid for such self-convergence is a deterioration of the individual electron beam spot shapes. The self-converging yoke magnetic field is astigmatic. It both overfocuses the vertical-plane electron beam rays, leading to deflected spots with appreciable vertical flare, and underfocuses the horizontal-plane rays, leading to slightly enlarged spot width.

It is desirable to avoid the astigmatism problem associated with a self-converging yoke by use of a yoke that is not self-converging. However, it is not desirable to return to use of dynamically varied magnetic fields for converging the beams.

The present invention provides a system that uses both a non-converging yoke and an electron gun that includes means for converging the electron beams.

SUMMARY OF THE INVENTION

A color display system includes a cathode-ray tube and yoke. The yoke is a non-converging type. The cathode-ray tube has an electron gun for generating and directing three electron beams, a center beam and two outer beams, along paths toward a screen of the tube. The electron gun includes electrodes that comprise a beam-forming region and electrodes that form a main focusing lens. The main focusing lens is formed by at least two focusing electrodes. The focusing electrode closest to the beam forming region includes at least two spaced parts. Each spaced part forms a portion of a dipole lens structure in the path of an outer electron beam. Means are provided for applying to at least one of the spaced parts a dynamic signal which is related to the deflection of the electron beams. The dipole lens structures establish electrostatic dipole fields in the paths of the outer electron beams that cause the outer beams to converge at the screen with the center beam for all angles of deflection.

DETAILED DESCRIPTION OF THE PREFERRED EMBODIMENTS

Figure 1:
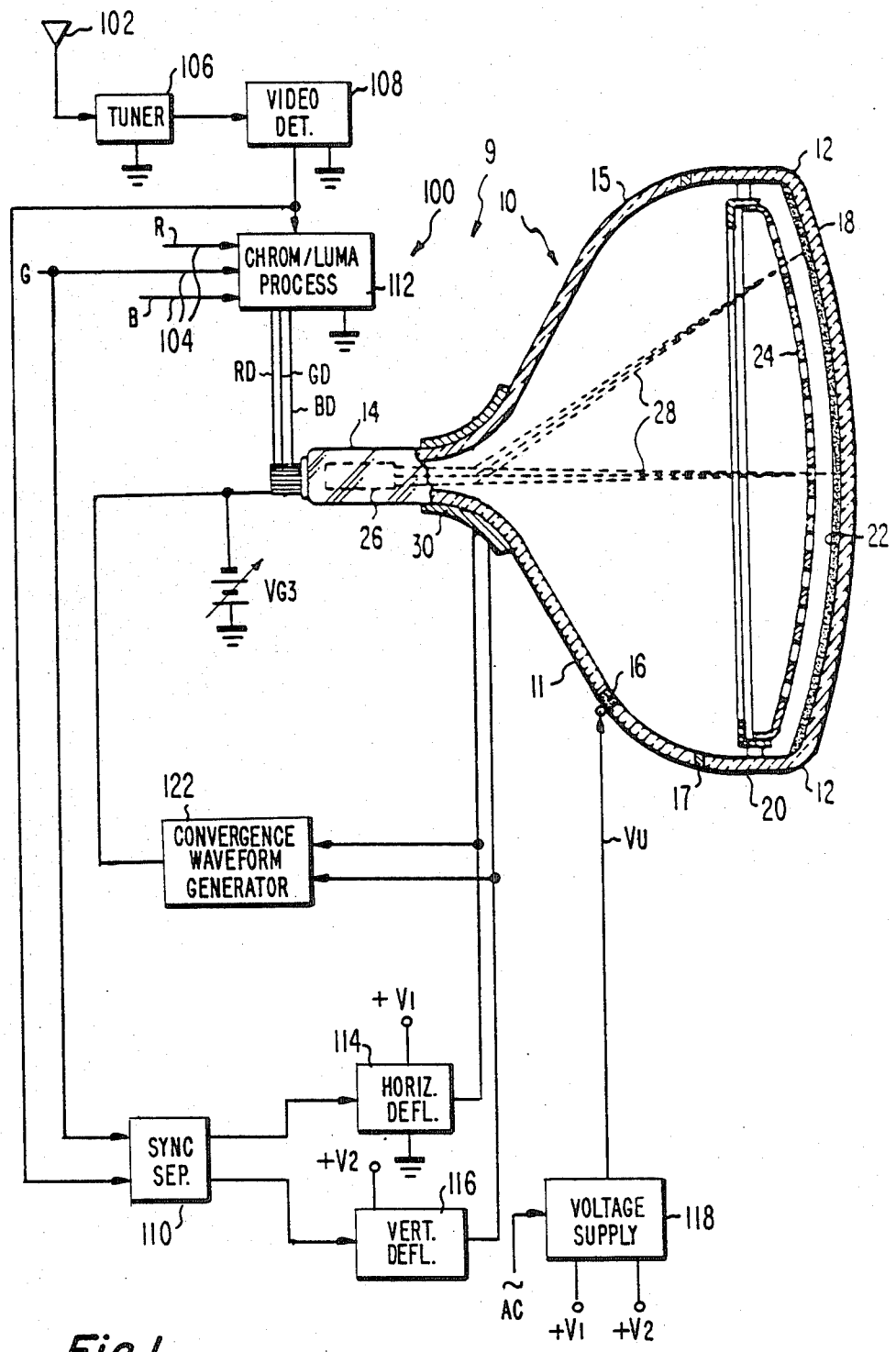
FIG. 1 is a plan view, partly in axial section, of a color display system embodying the invention.

FIG. 1 shows a color display system 9 including a rectangular color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a viewing faceplate 18 and a peripheral flange or sidewall 20 which is sealed to the funnel 15 by a glass frit 17. A three-color phosphor screen 22 is carried by the inner surface of the faceplate 18. The screen 22 preferably is a line screen with the phosphor lines arranged in triads, each triad including a phosphor line of each of the three colors. Alternatively, the screen can be a dot screen. A multiapertured color selection electrode or shadow mask 24 is removably mounted, by conventional means, in predetermined spaced relation to the screen 22. An improved electron gun 26, shown schematically by dotted lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvature of the deflection beam paths in the deflection zone is not shown in FIG. 1. In the preferred embodiments, the yoke 30 is a non-converging type and does not converge the electron beams as does a self-converging yoke.

FIG. 1 also shows a portion of the electronics used for exciting the tube 10 and yoke 30. These electronics are described below.

Figure 2:
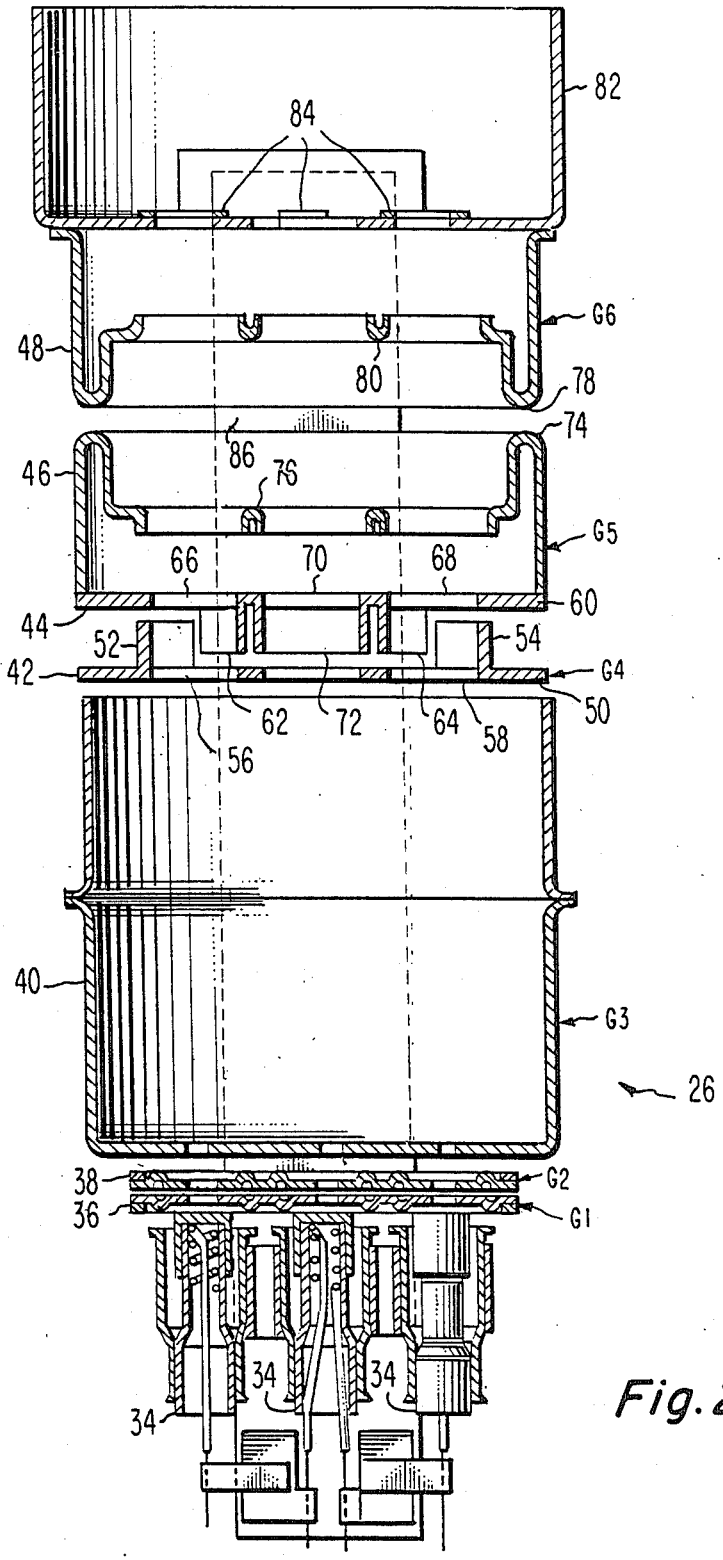
FIG. 2 is a partially cutaway axial section top view of the electron gun shown in dashed lines in FIG. 1.
Figure 3:
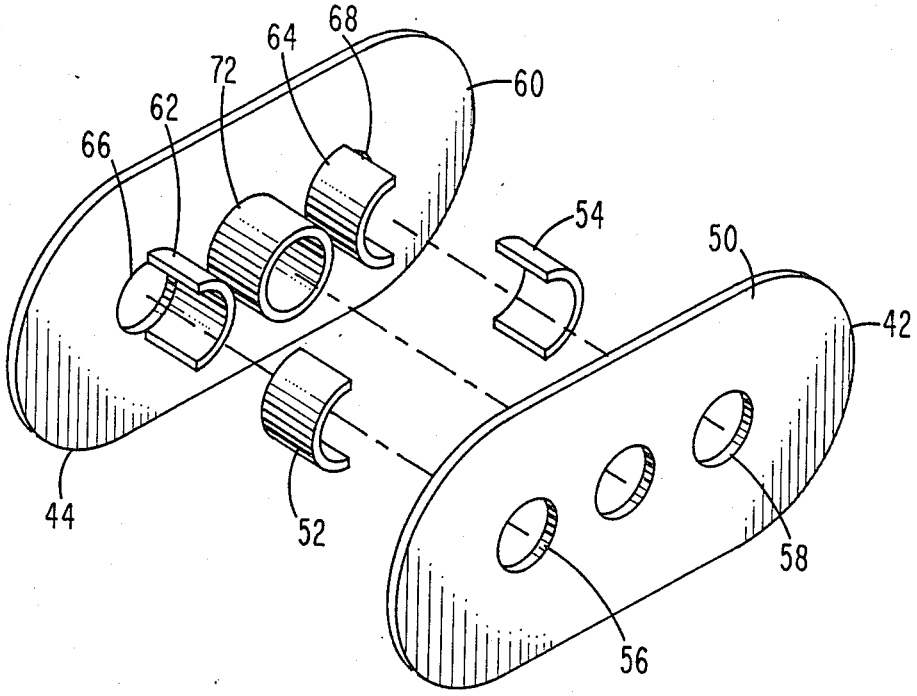
FIG. 3 is a broken-apart perspective view of the dipole electrodes of the electron gun of FIG. 2.

The details of the electron gun 26 are shown in FIGS. 2 and 3. The gun 26 comprises three spaced inline cathodes 34 (one for each beam), a control grid electrode 36 (G1), a screen grid electrode 38 (G2), an accelerating electrode 40 (G3), a first dipole lens electrode 42 (G4), a second dipole lens electrode 44 that is directly attached to a first main focusing lens electrode 46 (G5), and a second main focusing lens electrode 48 (G6). These electrodes are spaced in the order named. Each of the G1 through G6 electrodes has three inline apertures located therein to permit passage of three electron beams. The electrostatic main focusing lens in the gun 26 is formed by the facing portions of the G5 electrode 46 and the G6 electrode 48. The first dipole electrode 42 includes a plate 50 having semi-circular extrusions 52 and 54 around the outside halves of its two outer apertures, 56 and 58, respectively. The concave inside surfaces of the two extrusions 52 and 54 face each other. The second dipole electrode 44 includes a plate 60 having semi-circular extrusions 62 and 64 around the inside halves of its two outer apertures 66 and 68, respectively. The convex outside surfaces of the two extrusions 62 and 64 face each other, and the concave inside surfaces of the extrusions 62 and 64 face the concave inside surfaces of the extrusions 52 and 54, respectively. The center aperture 70 of the plate 60 includes a circular cylindrical extrusion 72 that extends toward the plate 50. The plate 60 of the second dipole electrode 44 is directly attached to the first main focusing lens electrode 46 so that the two electrodes 44 and 46 together may be considered the G5 electrode. The portion of the first main focusing lens electrode 46 that faces the second main focusing lens electrode 48 includes an oblong shaped leading edge 74 and an apertured portion 76 that is set back from the leading edge 74. The second main focusing electrode 48 is similarly shaped, having an oblong leading edge 78 facing the leading edge 74 and an apertured portion 80 that is set back from the leading edge 78. A shield cup 82 is attached to the electrode 48 at the exit of the electron gun. The shield cup 82 may include coma correction members 84, such as shown, or may contain coma correction members of different design.

All of the electrodes of the gun 26 are either directly or indirectly connected to two insulative support rods 86 (one shown). The rods 86 may extend to and support the G1 electrode 36 and the G2 electrode 38, or these two electrodes may be attached to the G3 electrode 40 by some other insulative means. In a preferred embodiment, the support rods are of glass, which has been heated and pressed onto claws extending from the electrodes, to embed the claws in the rods.

Referring back to FIG. 1, there is shown a portion of the electronics 100 that may operate the system as a television receiver and as a computer monitor. The electronics 100 is responsive to broadcast signals received via an antenna 102, and to direct red, green and blue (RGB) video signals via input terminals 104. The broadcast signal is applied to tuner and intermediate frequency (IF) circuitry 106, the output of which is applied to a video detector 108. The output of the video detector 108 is a composite video signal that is applied to a synchronizing signal (sync) separator 110 and a chrominance and luminance signal processor 112. The sync separator 110 generates horizontal and vertical synchronizing pulses that are, respectively, applied to horizontal and vertical deflection circuits 114 and 116. The horizontal deflection circuit 114 produces a horizontal deflection current in a horizontal deflection winding of the yoke 30, while the vertical deflection circuit 116 produces a vertical deflection current in a vertical deflection winding of the yoke 30.

In addition to receiving the composite video signal from the video detector 108, the chrominance and luminance signal processing circuit 112 alternatively may receive individual red, green and blue video signals from a computer, via the terminals 104. Synchronizing pulses may be supplied to the sync separator 110 via a separate conductor or, as shown in FIG. 1, associated with the green video signal. The output of the chrominance and luminance processing circuitry 112 comprises the red, green and blue color drive signals, that are applied to the electron gun 26 of the cathode ray tube 10 via conductors RD, GD and BD, respectively.

Power for the system is provided by a voltage supply 118, which is connected to an AC voltage source. The voltage supply 118 produces a regulated DC voltage level $+V_1$ that may, illustratively, be used to power the horizontal deflection circuit 114. The voltage supply 118 also produces DC voltage $+V_2$ that may be used to power the various circuits of the electronics, such as the vertical deflection circuit 116. The voltage supply further produces a high voltage $V_u$ that is applied to ultor terminal or anode button 16.

Circuits and components for the tuner 106, video detector 108, sync separator 110, processor 112, horizontal deflection circuit 114, vertical deflection circuit 116 and voltage supply 118 are well known in the art and, therefore, are not specifically described herein.

In addition to the foregoing elements, the electronics 100 includes a dynamic convergence waveform generator 122. The convergence waveform generator 122 provides a dynamically varied voltage $V_m$ to the sectioned G4 elements of the electron gun 26. The generator 122 receives the horizontal and vertical scan signals from the horizontal deflection circuit 114 and the vertical deflection circuit 116, respectively. The circuitry for the generator 122 can be that as is known in the art. Examples of such known circuits may be found in: U.S. Pat. Nos. 4,214,188, issued to Bafaro et al. on July 22, 1980; 4,258,298, issued to Hilburn et al. on Mar. 24, 1981; and 4,316,128, issued to Shiratsuchi on Feb. 16, 1982. These patents are hereby incorporated by reference for their showings of such dynamic circuitry.

Figure 5:
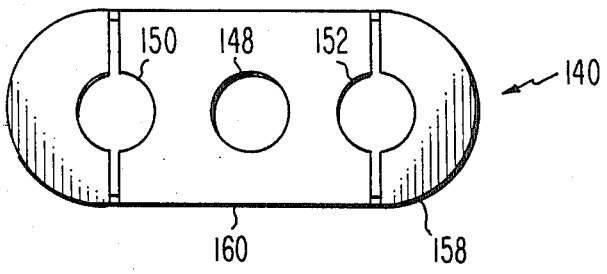
FIG. 5 is a sectional view of the electron gun taken at line 5—5 of FIG. 4.
Figure 4:
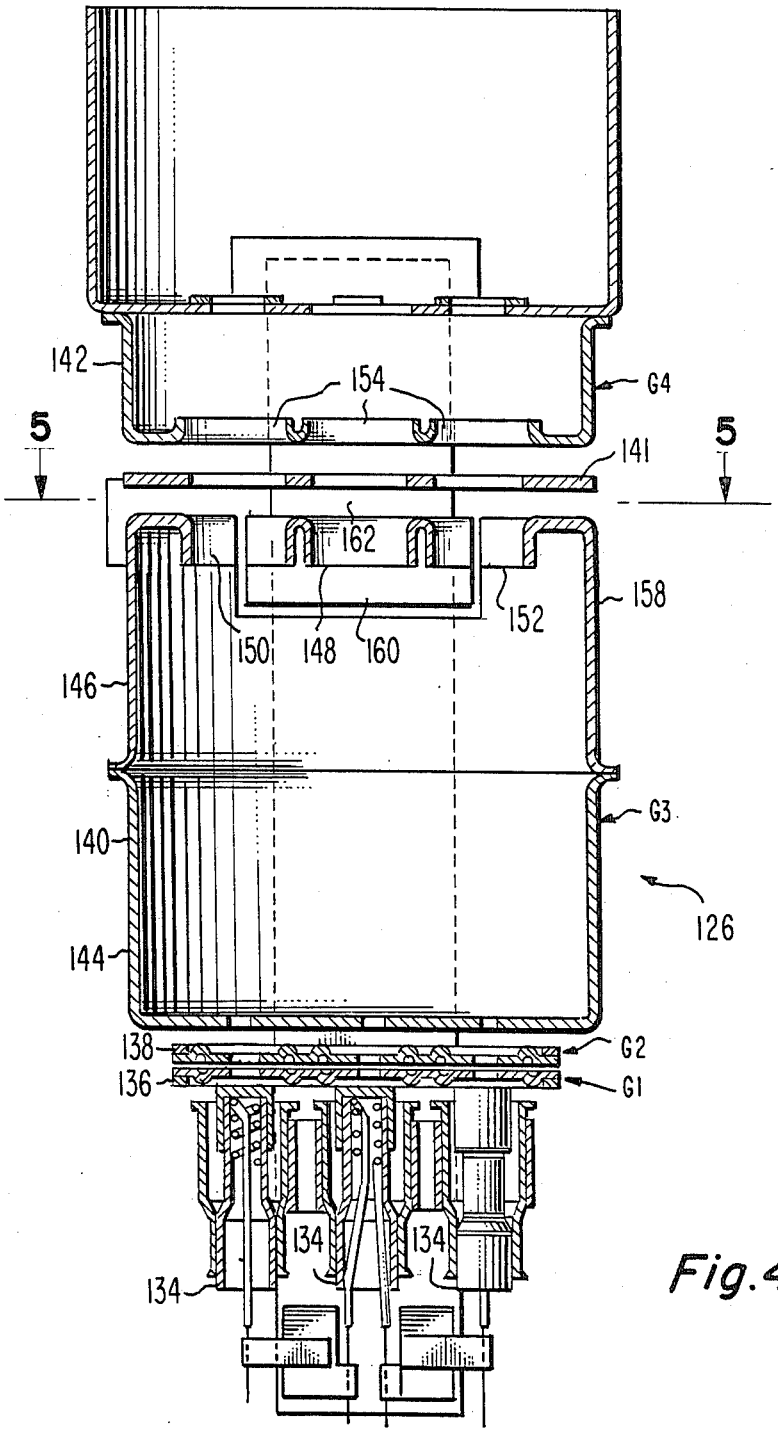
FIG. 4 is a partially cutaway axial section top view of another electron gun.

The details of another electron gun 126, that may be used in an embodiment of the present invention, are shown in FIGS. 4 and 5. The gun 126 comprises three spaced inline cathodes 134, a control grid electrode 136 (G1), a screen grid electrode 138 (G2), a first main focusing lens electrode 140 (G3) that includes an electrically connected buffer plate 141, and a second main focusing lens electrode 142 (G4), spaced in the order named. Each of the G1 through G4 electrodes has three inline apertures located therein to permit passage of three electron beams. The electrostatic main focusing lens in the gun 126 is formed by the facing portions of the G3 electrode buffer plate 141 and the G4 electrode 142. The main body of the G3 electrode 140 is formed with two cup-shaped elements 144 and 146. The open ends of the two elements, 144 and 146, are attached to each other. The buffer plate 141 has three inline apertures therein. The G4 electrode 142 is cup-shaped with its closed end facing the buffer plate 141 of the G3 electrode 140. The element 146 includes a center aperture 148 and two side or outer apertures 150 and 152. Each of these apertures includes extrusions that extend into the cup-shaped element 146. The facing portion of the G4 electrode 142 contains three corresponding inline apertures 154.

The element 146 of the G3 electrode 140 is split into two parts, 158 and 160. A central part 160 is formed by a gap extending down through the electrode at the center of the outer aperture 150, then, at a right angle thereto to the center of the other outer aperture 152, and, then, at a right angle up through the center of the aperture 152. The center aperture 148 and the inside halves of the two outer apertures 150 and 152 are formed in the center part 160. The outer halves of the outer apertures 150 and 152 are formed in the part 158. The electrodes, including the buffer plate 141, are held by two support rods 162 (one shown). The center part 160 is held in position relative to the remaining part 158 of the element 146, by attachment to the support rods 162, to maintain the gap therebetween.

In the electron gun 126, the dynamic voltage, $V_{G3}-\Delta V$, is applied to the center part 160. The electrostatic field forming the main focusing lens forms between the buffer plate 141 and the G4 electrode 142. In this embodiment, the buffer plate 141 isolates the main focusing lens from the dipole fields formed by the parts 158 and 160.

Figure 6:
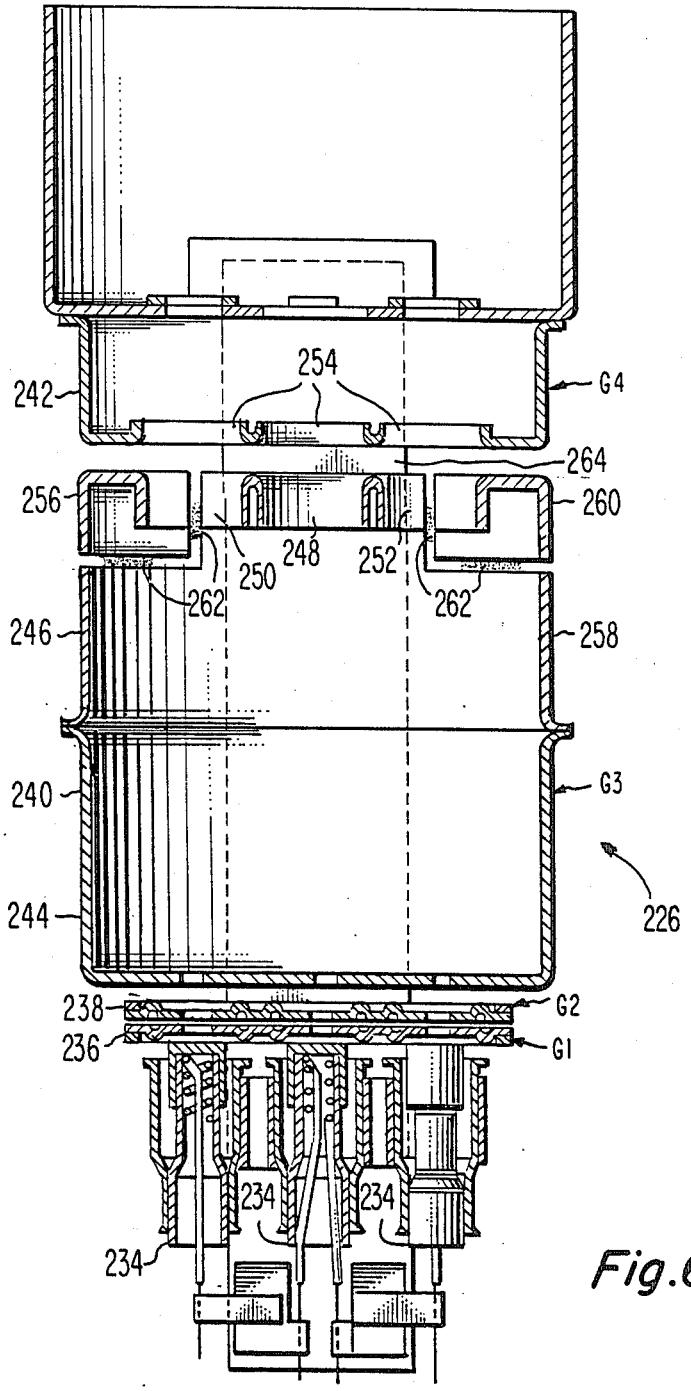
FIG. 6 is a partially cutaway axial section top view of yet another electron gun.

The details of a third electron gun 226, that may be used in an embodiment of the present invention, are shown in FIG. 6. The gun 226 comprises three spaced inline cathodes 234, a control grid electrode 236 (G1), a screen grid electrode 238 (G2), a first main focusing lens electrode 240 (G3), and a second main focusing lens electrode 242 (G4), spaced in the order named. Each of the G1 through G4 electrodes has three inline apertures located therein to permit passage of three electron beams. The electrostatic main focusing lens in the gun 226 is formed by the facing portions of the G3 electrode 240 and the G4 electrode 242. The G3 electrode 240 is formed with two cup-shaped elements 244 and 246. The open ends of the two elements, 244 and 246, are attached to each other. The G4 electrode 242 is cup-shaped with its closed end facing the closed end of the element 246 of the G3 electrode 240. The element 246 includes a center aperture 248 and two side or outer apertures 250 and 252. The facing portion of the G4 electrode 242 contains three corresponding inline apertures 254.

The element 246 of the G3 electrode 240 is split into three parts, 256, 258 and 260. One part, 256, is formed by a gap extending down through the electrode at the center of the aperture 250 and, then, at a right angle thereto out through the side of the electrode. Similarly, the part 260 is formed by a gap extending down through the electrode at the center of the aperture 252 and at a right angle thereto out through the opposite side of the electrode. The center aperture 248 and half of each of the side apertures 250 and 252 are formed in the center part 258. The other half of each of the outer apertures 250 and 252 are formed in the parts 256 and 260, respectively. The parts 256 and 260 are attached to the part 258 by an insulating cement 262. All of the electrodes of the gun 226 are either directly or indirectly connected to two insulative support rods 264 (one shown). In the electron gun 226, the dynamic voltage, $V_{G3}+\Delta V$, is applied to the parts 256 and 260.

Figure 7:
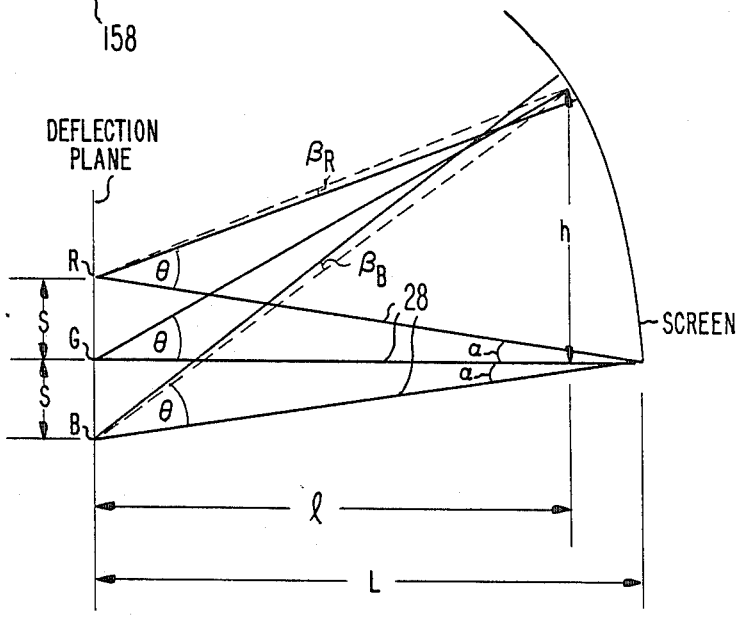
FIG. 7 is a diagram of three electron beams in undeflected and deflected positions used to explain dynamic convergence.

FIG. 7 is a diagram of the three electron beams 28, when undeflected and deflected, similar to the showing in FIG. 1. In the diagram, R, G and B represent the centers of the red, green and blue electron beams, respectively, in the deflection plane. Beam center to beam center spacing in the deflection plane is labelled s. The angle through which the electron beams are deflected is labelled $\theta$. The distance along the central longitudinal axis of the tube from the deflection plane to the screen is labelled L. The perpendicular distance from the undeflected center beam to the intersection of the deflected center beam with the screen is labelled h. The distance along the central longitudinal axis from the deflection plane to the perpendicular plane passing through deflected center beam intersection with the mask is labelled l. The angles $\alpha$ are the convergence angles the outer beams R and B make with the center beam G at the screen. The angles $\beta_R$ and $\beta_B$ represent the angles between the unconverged beam paths, shown in solid lines, with the desired converged beam paths, shown in dashed lines, for the outer red, R, and blue, B, beams, respectively. The following relationships hold for the diagram.

$$\text{Tan}\ \theta = \frac{h}{l} \tag{1}$$

$$\text{Tan}\ (\theta + \beta_R - \alpha) = \frac{h - s}{l} \tag{2}$$

$$\text{Tan}\ (\theta - \beta_B + \alpha) = \frac{h + s}{l} \tag{3}$$

The above equations can be used for estimating the magnitude of the correction angles, $\beta_R$ and $\beta_B$, necessary to achieve convergence.

For a 48 cm diagonal tube, such as RCA tube A4-8AAD10X, the pertinent dimensions are: s=0.508 cm (0.200 inch), L=21.641 cm (8.52 inches), h=20.218 cm (7.96 inches), and, since l=h cot $\theta$, then l=17.882 cm (7.04 inches) for a deflection angle to the side of the screen of 48.5°. Since tan $\alpha$=s/L, then $\alpha$=1.345°, and with a 48.5° deflection angle, $\beta_R$=0.629°, and $\beta_B$=0.632°.

Since $\beta_R$ and $\beta_B$ differ by less than 1% of their values, common voltages can be applied to both of the G3 sectioned elements 256 and 260 of the electron gun 226, to the G4 electrode at the electron gun 26 and to the center part 160 of the electron gun 126. In the above-identified RCA tube operated at an ultor voltage $V_u$ of 25 KV and a focus voltage $V_{G3}$ of 7000 V, the correction voltage $\Delta V$ required at the 48.5° deflection position is 290 V. This is a value that can be readily applied to a gun electrode. Other tube voltages are cathode voltage $V_K$ equal to 150 V minus the video drive voltage, G1 grid voltage equal to zero, and G2 grid voltage equal to 600 V.

What is claimed is:

1. In a color display system including a cathode-ray tube having an inline electron gun for generating and directing three electron beams, a center beam and two outer beams, along paths toward a screen of said tube, said gun including electrodes comprising a beam-forming region and electrodes for forming a main focusing lens, and said system including a non-converging yoke, the improvement comprising the main focusing lens electrode closest to the beam-forming region including at least two parts spaced laterally to the electron beam paths, one of said parts being located outwardly from an outer beam path, said outwardly located part being positioned on a side of the respective outer beam path opposite that facing the center beam path, and another of said parts being located inwardly from an outer beam path, said inwardly located part being positioned between the respective outer beam path and the center beam path, said outwardly and inwardly located parts forming a dipole lens structure in the path of an outer electron beam, and means for applying to at least one of said spaced parts a dynamic signal which is related to deflection of the electron beams, whereby an electrostatic dipole field is established in the path of an outer beam that causes that outer beam to converge with the center beam for all angles of deflection.

2. A color display system according to claim 1, wherein said outwardly and inwardly located parts are segments of a cylinder surrounding an outer beam path.

3. A color display system according to claim 2 including said main focusing lens electrode closest to the beam-forming region comprising three separated portions spaced longitudinally along the electron beam paths, the center of said separated portions including said outwardly located part and the separated portion further from said beam-forming region including said inwardly located part.

4. A color display system according to claim 2 including said main focusing lens electrode closest to the beam-forming region comprising three separated portions, a first of said portions including two outwardly located parts and including a centered recess therein, a second of said portions located within said recess including two inwardly located parts, and a third of said portions being an apertured plate located adjacent to the main focusing lens furthest from the beam-forming region.

5. A color display system according to claim 2 including said main focusing lens electrode closest to the beam-forming region comprising three separated portions, a first of said portions including two inwardly located parts, a second of said portions including one outwardly located part, and a third portion including another outwardly located part.

* * * * *